US011577268B2

(12) United States Patent
Flego et al.

(10) Patent No.: US 11,577,268 B2
(45) Date of Patent: Feb. 14, 2023

(54) DEVICE FOR ATOMIZING FLUID

(71) Applicant: OVR Tech, LLC, Burlington, VT (US)

(72) Inventors: Matthew Flego, Burlington, VT (US); Yehuda Ivri, Newport Coast, CA (US); Erik Cooper, Burlington, VT (US); Aaron Wisniewski, Burlington, VT (US); Samuel Wisniewski, Burlington, VT (US)

(73) Assignee: OVR Tech, LLC, Burlington, VT (US)

( * ) Notice: Subject to any disclaimer, the term of this patent is extended or adjusted under 35 U.S.C. 154(b) by 198 days.

(21) Appl. No.: 16/657,313

(22) Filed: Oct. 18, 2019

(65) Prior Publication Data

US 2020/0122182 A1 Apr. 23, 2020

Related U.S. Application Data

(60) Provisional application No. 62/747,502, filed on Oct. 18, 2018.

(51) Int. Cl.
*B05B 17/06* (2006.01)
*B05B 17/00* (2006.01)

(52) U.S. Cl.
CPC ..... *B05B 17/0646* (2013.01); *B05B 17/0669* (2013.01)

(58) Field of Classification Search
CPC ..... B05B 17/0646; B05B 17/0669; B05B 17/0638
See application file for complete search history.

(56) References Cited

U.S. PATENT DOCUMENTS

| | | | |
|---|---|---|---|
| 4,952,024 | A | 8/1990 | Gale |
| 5,318,503 | A | 6/1994 | Lord |
| 5,591,409 | A | 1/1997 | Watkins |
| 5,610,674 | A | 3/1997 | Martin |
| 5,898,475 | A | 4/1999 | Martin |
| 6,231,032 | B1 | 5/2001 | Ivey, Jr. |
| 6,296,196 | B1 | 10/2001 | Denen et al. |
| 6,371,451 | B1 | 4/2002 | Choi |
| 6,713,024 | B1 | 3/2004 | Arnell et al. |
| 6,737,025 | B2 | 5/2004 | Boyd et al. |

(Continued)

FOREIGN PATENT DOCUMENTS

| | | | |
|---|---|---|---|
| CA | 2814977 | A1 | 5/2012 |
| EP | 2 119 465 | A1 | 11/2009 |

(Continued)

OTHER PUBLICATIONS

U.S. Appl. No. 16/871,447, filed May 11, 2020, Flego et al.

(Continued)

*Primary Examiner* — QingZhang Zhou
(74) *Attorney, Agent, or Firm* — Wolf, Greenfield & Sacks, P.C.

(57) ABSTRACT

An atomizer is provided for dispensing liquids into the air. In some implementations, a device is provided for generating atomized fluid specifically, but not exclusively, for production of small droplets of scented oil and other fluid-based fragrances, among other types of liquids. In some embodiments, the device comprises a tube-shaped element having a proximal opening and a distal opening, wherein media positioned inside the tube is forced out of the proximal opening via an aperture plate.

12 Claims, 7 Drawing Sheets

(56) References Cited

U.S. PATENT DOCUMENTS

| | | | | |
|---|---|---|---|---|
| 7,154,579 | B2 | 12/2006 | Selander et al. | |
| 7,395,507 | B2 | 7/2008 | Robarts et al. | |
| 7,584,903 | B2 * | 9/2009 | Koerner | F04B 43/043 239/102.1 |
| 7,651,077 | B1 | 1/2010 | Rosener et al. | |
| 7,913,933 | B2 | 3/2011 | Van Roemburg | |
| 8,012,023 | B2 | 9/2011 | Gates, III et al. | |
| 8,074,640 | B2 | 12/2011 | Davies et al. | |
| 8,341,022 | B2 | 12/2012 | Edwards | |
| 8,706,518 | B2 | 4/2014 | Hyde et al. | |
| 8,727,234 | B2 | 5/2014 | Haran | |
| 8,821,802 | B2 | 9/2014 | Haran | |
| 8,881,999 | B2 | 11/2014 | Blaylock et al. | |
| 9,283,296 | B2 | 3/2016 | Haran et al. | |
| 9,289,530 | B2 | 3/2016 | Haran et al. | |
| 9,446,162 | B2 | 9/2016 | Chandler et al. | |
| 9,586,228 | B2 | 3/2017 | Roemburg et al. | |
| 9,648,907 | B2 | 5/2017 | Kobal et al. | |
| 9,652,037 | B2 | 5/2017 | Rubin et al. | |
| 9,728,006 | B2 | 8/2017 | Varga | |
| 9,746,912 | B2 | 8/2017 | Meijer et al. | |
| 9,755,848 | B2 | 9/2017 | Cieszkowski, III et al. | |
| 9,811,854 | B2 | 11/2017 | Lucido | |
| 9,823,473 | B2 | 11/2017 | Kobayashi | |
| 9,872,968 | B2 | 1/2018 | de Zambottti et al. | |
| 9,904,358 | B2 | 2/2018 | Rubin et al. | |
| 9,907,876 | B2 | 3/2018 | Jin et al. | |
| 10,688,389 | B2 | 6/2020 | Flego et al. | |
| 11,013,264 | B2 * | 5/2021 | Sanchez | A24F 40/30 |
| 2002/0129813 | A1 | 9/2002 | Litherland et al. | |
| 2007/0258849 | A1 | 11/2007 | Kent | |
| 2008/0092912 | A1 * | 4/2008 | Robinson | A24B 13/02 131/200 |
| 2010/0019057 | A1 | 1/2010 | Duru et al. | |
| 2011/0045050 | A1 | 2/2011 | Elbayoumi et al. | |
| 2011/0148607 | A1 | 6/2011 | Zeleny | |
| 2014/0374503 | A1 | 12/2014 | Yoshimura et al. | |
| 2016/0296367 | A1 | 10/2016 | Ivri | |
| 2016/0363280 | A1 * | 12/2016 | Angelotti | B05B 17/0684 |
| 2017/0065000 | A1 | 3/2017 | Sears et al. | |
| 2017/0112666 | A1 | 4/2017 | Fateh | |
| 2017/0224938 | A1 | 8/2017 | Power et al. | |
| 2017/0274279 | A1 | 9/2017 | Fateh | |
| 2018/0071425 | A1 | 3/2018 | Jin et al. | |
| 2018/0286351 | A1 | 10/2018 | Fateh | |
| 2019/0176034 | A1 | 6/2019 | Flego et al. | |
| 2020/0330860 | A1 | 10/2020 | Flego et al. | |
| 2021/0001214 | A1 | 1/2021 | Wisniewski et al. | |
| 2021/0008446 | A1 | 1/2021 | Cooper et al. | |
| 2021/0121835 | A1 | 4/2021 | Wisniewski et al. | |

FOREIGN PATENT DOCUMENTS

| | | | |
|---|---|---|---|
| WO | WO 92/05229 | A1 | 4/1992 |
| WO | WO 2009/067734 | A1 | 6/2009 |
| WO | WO 2014/144690 | A2 | 9/2014 |
| WO | WO 2015/143444 | A1 | 9/2015 |
| WO | WO 2016/164917 | A1 | 10/2016 |
| WO | WO 2016/179167 | A1 | 11/2016 |
| WO | WO 2019/035786 | A2 | 2/2019 |
| WO | WO 2019/118738 | A1 | 6/2019 |

OTHER PUBLICATIONS

PCT/US2018/065476, Apr. 5, 2019, International Search Report and Written Opinion.

PCT/US2018/065476, Jun. 25, 2020, International Preliminary Report on Patentability.

PCT/US2019/057023, Jan. 14, 2020, International Search Report and Written Opinion.

International Search Report and Written Opinion dated Dec. 22, 2020 in connection with International Application No. PCT/US2020/052592.

International Search Report and Written Opinion dated Dec. 17, 2020 in connection with International Application No. PCT/US2020/052543.

International Search Report and Written Opinion dated Dec. 23, 2020 in connection with International Application No. PCT/US2020/052548.

International Preliminary Report on Patentability dated Apr. 29, 2021 in connection with International Application No. PCT/US2019/057023.

Ischer et al., How incorporation of scents could enhance immersive virtual experiences. Frontiers in Psychology. Jul. 17, 2014; 5:1-11.

International Search Report and Written Opinion dated Jan. 14, 2020 in connection with International Application No. PCT/US2019/057023.

International Search Report and Written Opinion dated Apr. 5, 2019 in connection with International Application No. PCT/US2018/065476.

International Preliminary Report on Patentability dated Jun. 25, 2020 in connection with International Application No. PCT/US2018/065476.

Extended European Search Report dated Oct. 26, 2021 in connection with European Application No. 18887380.6 (00418.70000EPOO).

* cited by examiner

DEVICE FOR ATOMIZING FLUID

RELATED APPLICATIONS

This application claims the benefit under 35 U.S.C. § 119(e) to commonly-owned U.S. provisional patent application Ser. No. 62/747,502, entitled "DEVICE FOR ATOMIZING FLUID", filed on Oct. 18, 2018, which is hereby incorporated by reference in its entirety.

NOTICE OF MATERIAL SUBJECT TO COPYRIGHT PROTECTION

Portions of the material in this patent document are subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

There are many methods for producing fragrances, including ones used in a variety of environments and systems. Some are passive, such as those with degrading media such as those in household air fresheners, to more sophisticated systems using active devices that control the release of scented media into the air.

SUMMARY

In some embodiments, an atomizer is provided for dispensing liquids into the air. In some implementations, a device is provided for generating atomized fluid specifically, but not exclusively, for production of small droplets of scented oil and other fluid-based fragrances, among other types of liquids. In some embodiments, the device comprises a tube having a proximal opening and a distal opening, wherein media inside the tube is forced out of the proximal opening via an aperture plate. Although the aerosol-generating device may include a tube, it should be appreciated that the generator may include different structures that are capable of vibrating and producing an aerosol through small openings.

In some embodiments, the aerosol generating device (e.g., a tube) further includes at least one piezoelectric plate that is attached to a face of the tube. The device further includes an aperture plate that is attached to the proximal end of the tube whereas the distal end of the tube is connected to a fluid supply source for supplying fluid through the tube to aperture plate at the proximal end of the tube. In some embodiments, the aperture plate includes a plurality of apertures that extend through the thickness of the plate.

In some embodiments, the device comprises a tube having a proximal opening and a distal opening, wherein fluid enters the distal end and is forced out of the proximal opening via an aperture plate. In some embodiments, fluid may be existing within the tube and/or added via the distal end, such as by a mechanism to add fluid as the device operates and forces the fluid out. In some embodiments, the device is provided with the fluid located within the tube.

The device further includes a signal generator circuit capable of producing an electrical signal at a selected frequency and voltage. When the frequency generator is connected to the piezo plate, cyclical stress waves are generated by the piezo plate which subsequently propagates along the length of the tube and produces oscillation which vibrates the aperture plate and generates a flow of atomized liquid through the apertures. In some embodiments, it is desirable that at least one surface of the tube has sufficient surface area and enables attachment of the piezo substrate. In some embodiments, the tube may be rectangular in shape, and a surface of the piezo substrate may be affixed to a substantial portion of a surface of the tube. In some embodiments, the piezo element is positioned more closely to distal end, allowing the stress waves to travel more significantly to the proximal opening.

In some embodiments, a single piezo attached to the tube generates longitudinal oscillation within the tube. In some embodiments, the tube does not bend due to the tube shape structure having a very high bending stiffness due to high moment of inertia of the tube's cross sectional shape. However, vibration is produced within the tube as the piezo may vibrate with a resonant frequency of the tube, and the cyclical stress waves force the liquid through the apertures.

In some embodiments, a plurality of devices may be placed in a linear array. In such an arrangement, it may be desirable that one side of the tube will be narrow such that multiplicity of devices can be stacked together with a minimum space.

In some embodiments, the induced frequency produced by the piezo element is equal to the natural frequency of the rectangular tube in a longitudinal mode or bending mode.

In some embodiments, the tube is a rectangular tube having two wide faces such that the area of at least one of the faces is sufficiently wide to attach at least one piezoelectric element that is capable of generating a sufficient amplitude.

In some embodiments, the tube has trapezoidal cross-sectional shape and having at least one face that is sufficient to attach at least one piezoelectric element that is capable of generating a large amplitude.

In some embodiments, the tube has a circular cross-sectional shape and includes a piezoelectric element disposed about a circumference of the tube.

In one embodiment the tube is circular in cross-sectional shape and having one face that is sufficient to attach at least one piezoelectric element that is capable of generate large amplitude. In one specific embodiment, the width of the tube is between 0.05 mm to 28 mm and the length between 1 mm and 154 mm. In some embodiments, the device may be relatively small such that multiple elements may be provided together in an array which can be included in a consumer device used with/in XR-related devices (e.g., augmented reality (AR), virtual reality (VR), mixed reality (MR) devices). In some embodiments, it is appreciated that a small device may be preferred for some applications, yet the size may be optimized so as to not require an excessively large resonant frequency. In some embodiments, the aperture plate is secured to the end of the tube via solder or glue and covers the entirety of the end of the tube. In some techniques, the aperture plate is circular and bent before connecting to edge of the tube. Additionally, the aperture plates may be flat or domed with the dome shaped outward from the end of the tube.

In some other applications, the aperture plate is sized to fit perfectly on the end of the tube. In some implementations, aperture sizes may be less than approximately 10 μm. For instance, apertures of approximately 5 μm range (+/−2 μm) may work for some applications. Generally, smaller aperture sizes are preferred, but the aperture sizes may be optimized to reduce clogging and the amount of force necessary to generate atomized fluid.

In some embodiments, the tube of various shapes and sizes may be operated (e.g., by applying electrical signals) at an optimal resonant frequency. Such a frequency may be determined based on the tube, atomizer plate and piezoelectric element used. In some embodiments, a range of optimal frequencies may be used, and optimal sizes for the piezoelectric element may be chosen for a particular resonant frequency. In some embodiments, the resonant frequency of the piezoelectric element is the same as that of the aperture plate. In some embodiments, the size of the aperture plate, tube and piezoelectric element are optimized for aerosol generation.

Still other aspects, examples, and advantages of these exemplary aspects and examples, are discussed in detail below. Moreover, it is to be understood that both the foregoing information and the following detailed description are merely illustrative examples of various aspects and examples, and are intended to provide an overview or framework for understanding the nature and character of the claimed aspects and examples. Any example disclosed herein may be combined with any other example in any manner consistent with at least one of the objects, aims, and needs disclosed herein, and references to "an example," "some examples," "an alternate example," "various examples," "one example," "at least one example," "this and other examples" or the like are not necessarily mutually exclusive and are intended to indicate that a particular feature, structure, or characteristic described in connection with the example may be included in at least one example. The appearances of such terms herein are not necessarily all referring to the same example.

BRIEF DESCRIPTION OF DRAWINGS

Various aspects of at least one example are discussed below with reference to the accompanying figures, which are not intended to be drawn to scale. The figures are included to provide an illustration and a further understanding of the various aspects and examples, and are incorporated in and constitute a part of this specification, but are not intended as a definition of the limits of a particular example. The drawings, together with the remainder of the specification, serve to explain principles and operations of the described and claimed aspects and examples. In the figures, each identical or nearly identical component that is illustrated in various figures is represented by a like numeral. For purposes of clarity, not every component may be labeled in every figure. In the figures:

DETAILED DESCRIPTION

Figure 1A:
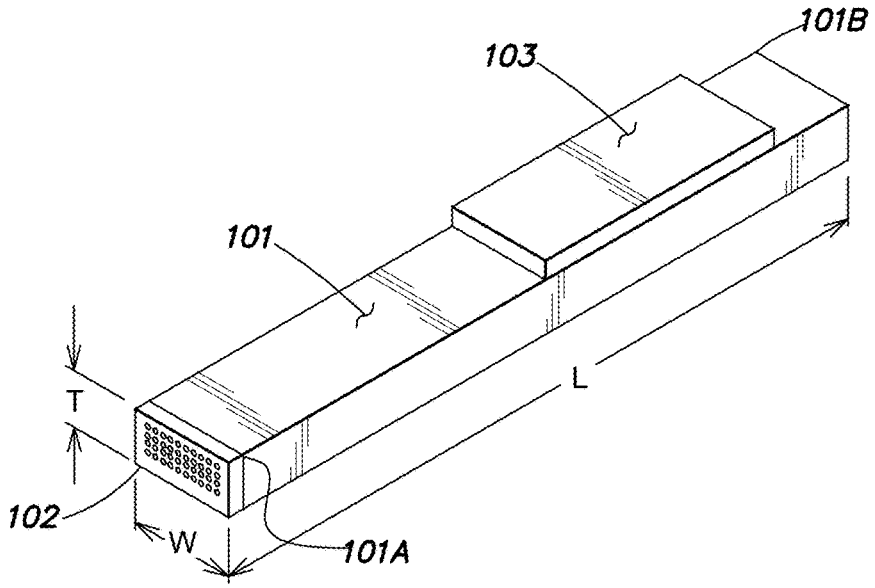
FIGS. 1A-1D shows some embodiments of a rectangular-shaped device configured to generate an atomized fluid.
Figure 1B:
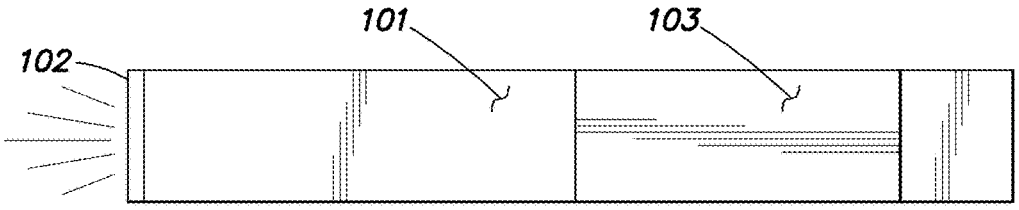
Figure 1C:
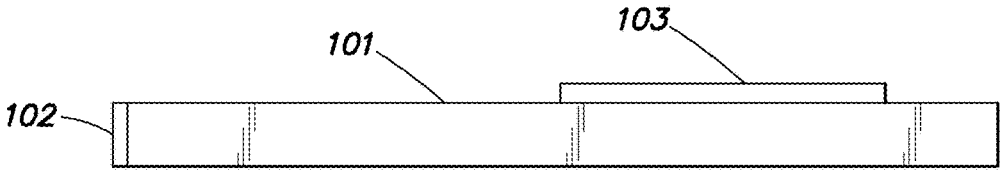
Figure 1D:
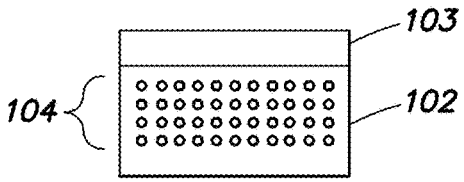

As discussed, in some embodiments, an atomizer is provided for dispensing liquids into the air. In some implementations, a device is provided for generating atomized fluid specifically, but not exclusively, for production of small droplets of scented oil and other fluid-based fragrances, among other types of liquids. In some embodiments, the device comprises a tube-shaped element having a proximal opening and a distal opening, wherein media positioned inside the tube is forced out of the proximal opening via an aperture plate.

FIGS. 1A-1D show some embodiments of a device for generating atomized fluid. The device comprises a rectangular tube (101) having a cross-sectional shape a width (W), a depth (T) and a length (L). Although a rectangular tube is shown, it should be appreciated that the tube shape and size is merely an example, and that other shapes and sizes may be used. As shown, a piezoelectric plate (103) is attached across the width (W) of the tube. In some embodiments, the piezoelectric plate (103) may be attached to the rectangular tube (101 via glue, epoxy, solder or other adhesive.

An aperture plate (102) is attached to an end of the tube (101A) while a second end (102B) is open and is configured to receiving a fluid and supplying the fluid to the aperture plate (102) through the tube. The piezoelectric plate (103) is connected to a circuit that generates an electrical signal at a frequency that is equal to the resonance frequency of tube and in an amplitude that is sufficient to produce a flow of atomized droplets. The electrical signal may be, in some embodiments, an alternating signal that is applied to contacts of the piezoelectric plate 103.

In one embodiment, the tube is made of brass and has a width of 6.35 mm, a depth of 3.125 mm, and a length of 40 mm, with a resonance frequency of 50,000 Hz. It should be appreciated however, that other dimensions, configurations and resonant frequencies may be used. In some embodiments, the piezo element and tube form a unimorph device including an active layer (e.g., the piezo element) and an inactive layer (e.g., the tube surface).

Figure 2A:
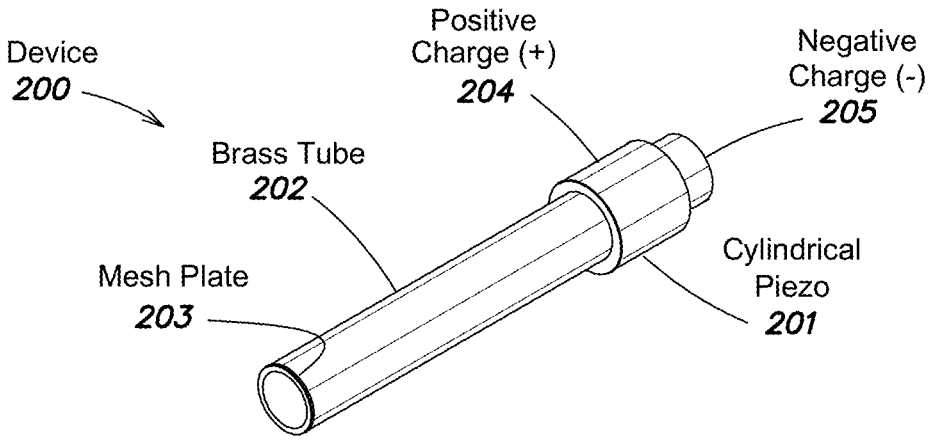
FIGS. 2A-2B show some embodiments of a cylindrically-shaped device configured to generate an atomized fluid.
Figure 2B:
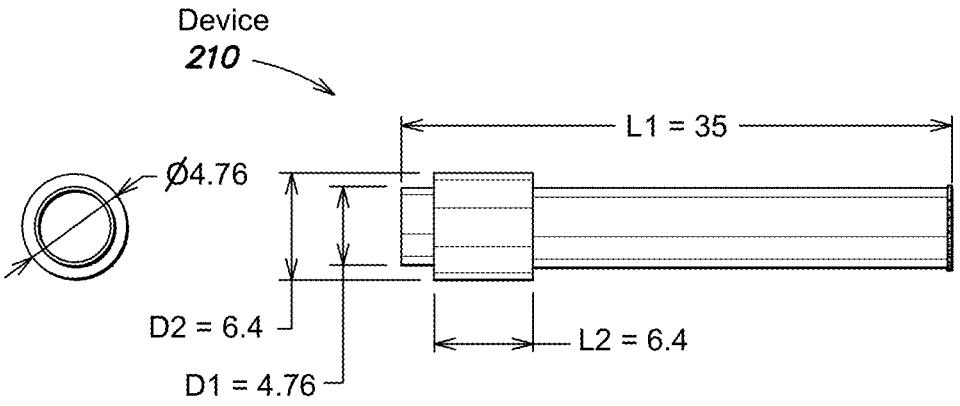

FIGS. 2A-2B show a device for generating atomized fluid according to some embodiments. In particular, FIG. 2A shows a round tube device 200 similar in function to the device discussed above with respect to FIGS. 1A-1D. Device 200 may include a tube 202 having a length (L1) and diameter (D1). A piezoelectric sleeve is attached at an end of the cylindrical tube, the element having a length (L2) and diameter (D2). In some embodiments, the piezoelectric sleeve may be attached to the cylindrical tube via glue, epoxy, solder or other adhesive.

Similar to the rectangular embodiment, an aperture plate (e.g., mesh plate 203) is attached to an end of the tube while a second end is open and is configured to receiving a fluid and supplying the fluid to the aperture plate through the tube. The piezoelectric element is connected to a circuit that generates an electrical signal at a frequency that is equal to the resonance frequency of tube and in an amplitude that is sufficient to produce a flow of atomized droplets. The electrical signal may be, in some embodiments, an alternating signal that is applied to contacts of the piezoelectric element (e.g., via positive charge 204 being applied to the piezo layer and a negative charge 205 being applied to the tube).

In one embodiment, the tube is made of brass and has a diameter of 4.76 mm, and a length of 35 mm, with a resonant frequency in a range of substantially 100-300 KHz. The piezo element may have a diameter of 6.4 mm and length of 6.4 mm. It should be appreciated however, that other dimensions, configurations and resonant frequencies may be used. For example, the range of the frequency that a particular device may function can vary from a relatively low frequency (e.g., 20 kHz) to a relatively high value (e.g., 1 GHz). Using the example circular tube devices described above, the resonant frequency may be determined to be in a range of 100-300 KHz. Generally speaking, if the size of the tube is decreased, the frequency increases, but it should be appreciated that the resonant frequency depends on a number of factors and can be determined heuristically from testing the device.

In some embodiments, the piezo element and tube form a unimorph device including an active layer (e.g., the piezo element) and an inactive layer (e.g., the tube surface). In some conventional piezo elements, they may use a pinching/squeezing mechanism to deliver liquids, however, in some embodiments as disclosed herein, a medium (e.g., a liquid) is aerosolized via perpendicular acoustical waves induced by a piezo element. It should be appreciated that although certain shaped devices having certain dimensions are shown, other shaped elements having different dimensions may be used.

Figure 3A:
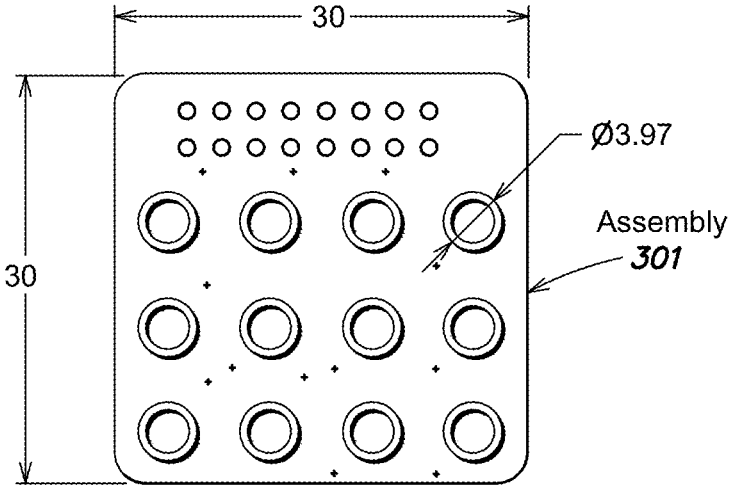
FIGS. 3A-3F show various embodiments and views of an assembly having an array of multiple cylindrical tubes.
Figure 3B:
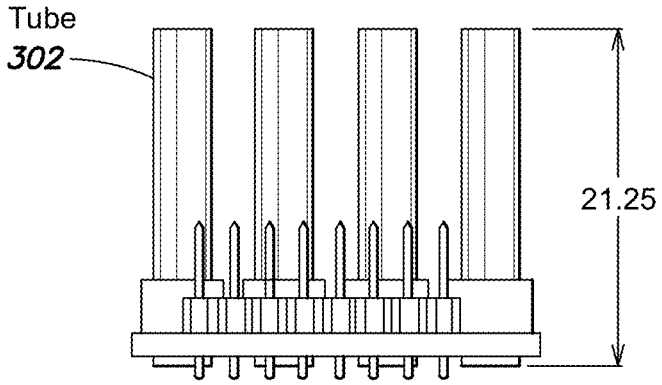
Figure 3C:
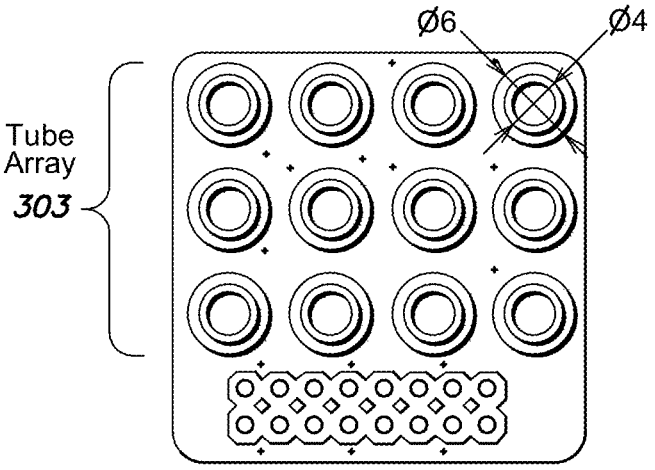
Figure 3D:
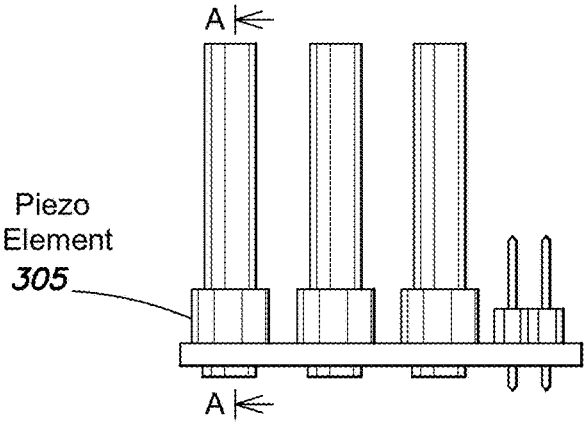
Figure 3E:
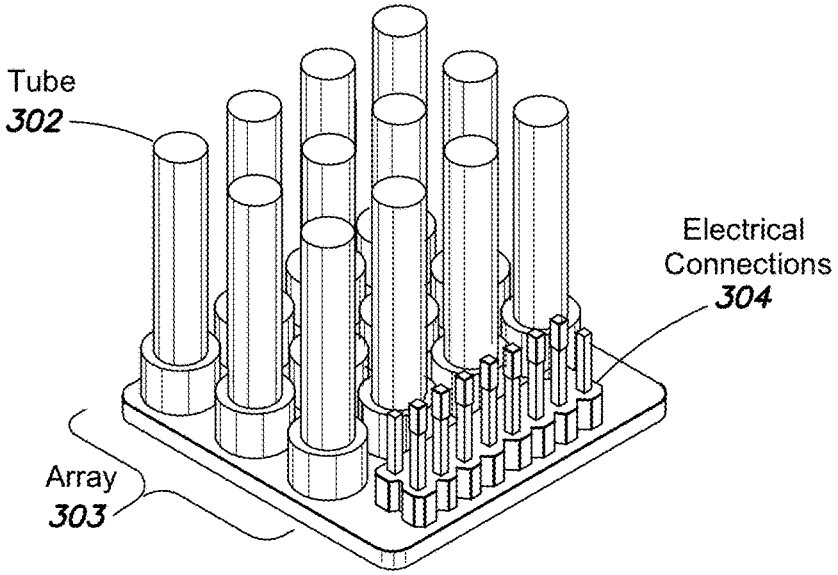
Figure 3F:
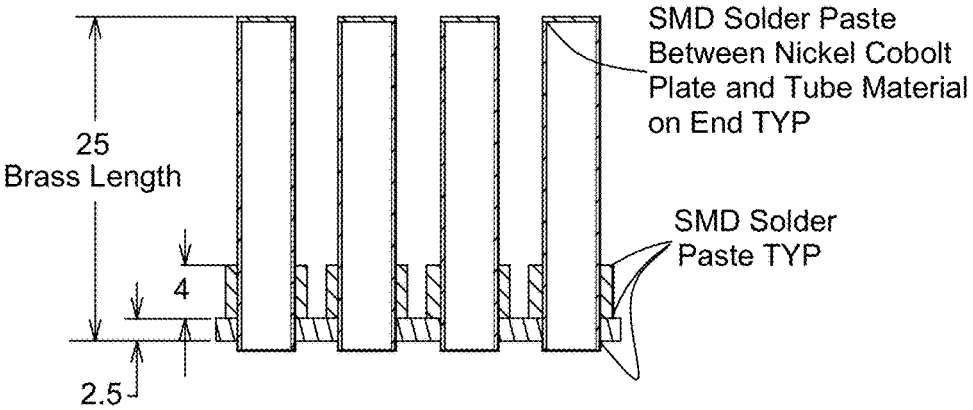
Figure 4A:
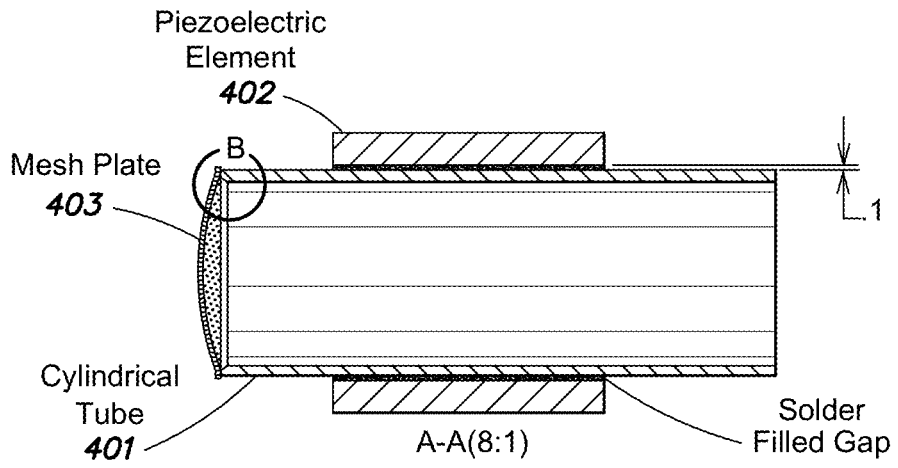
FIGS. 4A-4E show embodiments of another type of cylindrical tube.
Figure 4B:
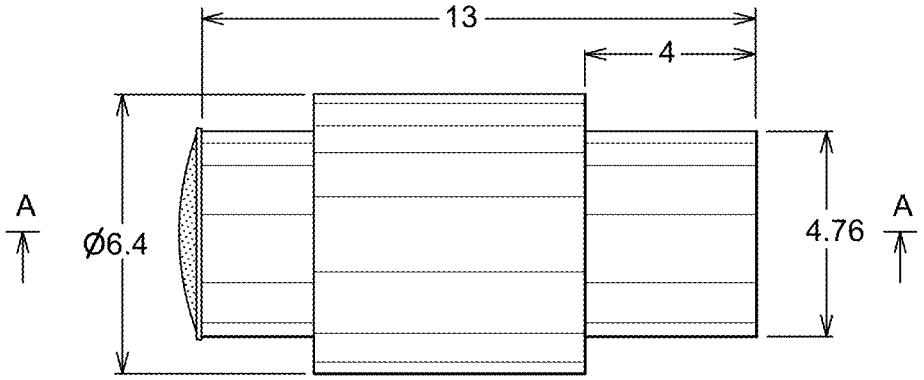
Figure 4C:
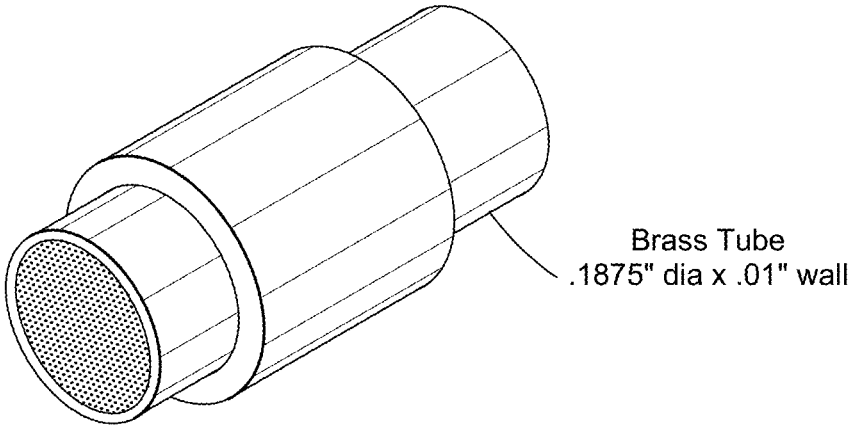
Figure 4D:
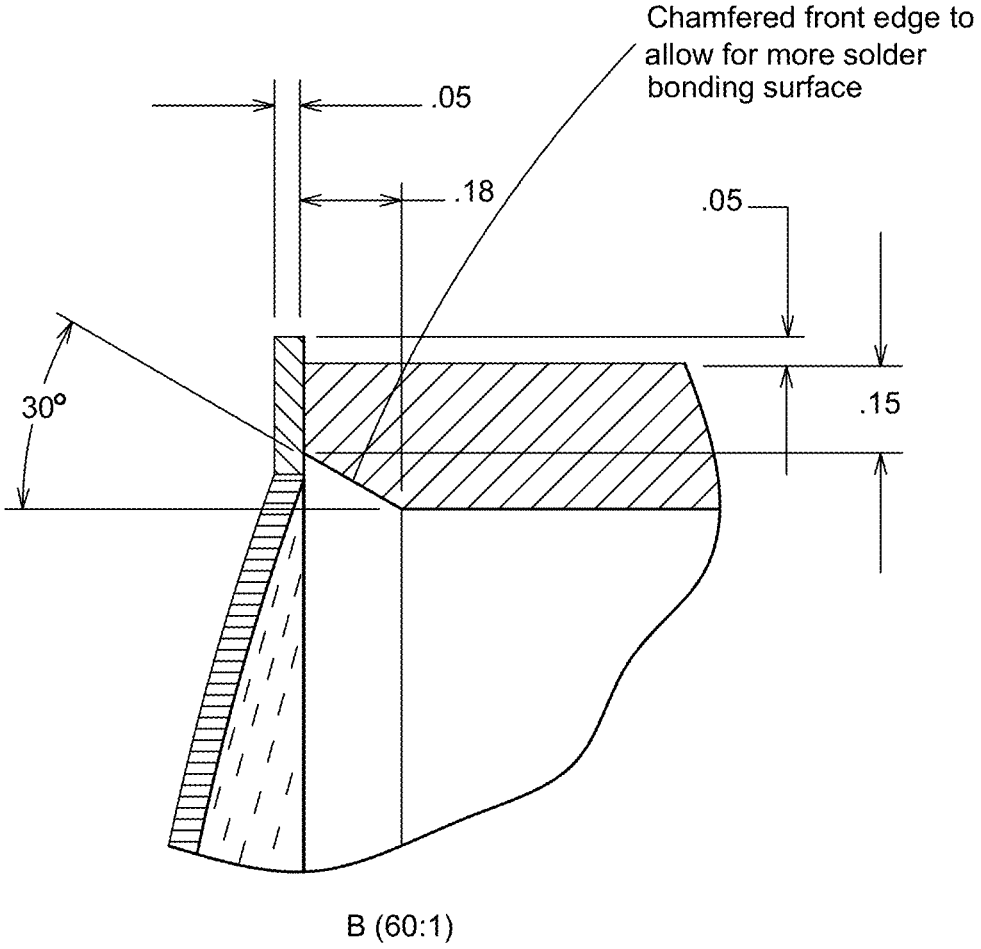
Figure 4E:
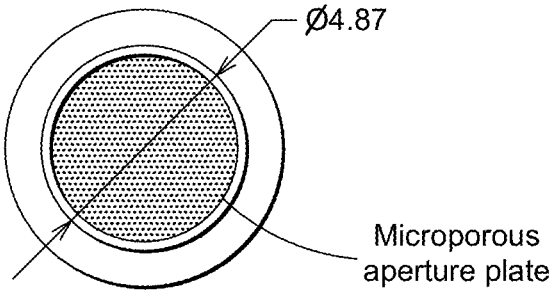
Figure 5B:
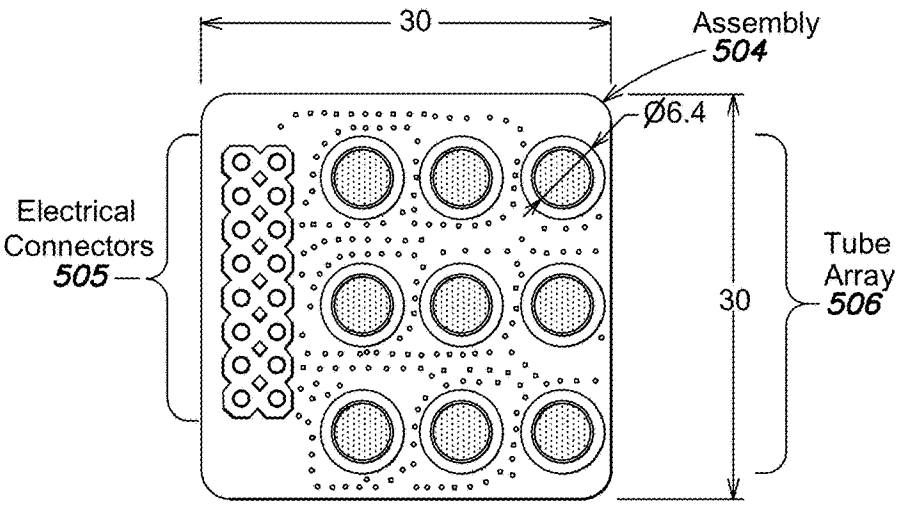
FIGS. 5A-5D show further embodiments of an example assembly having an array of cylindrical tube elements.
Figure 5D:
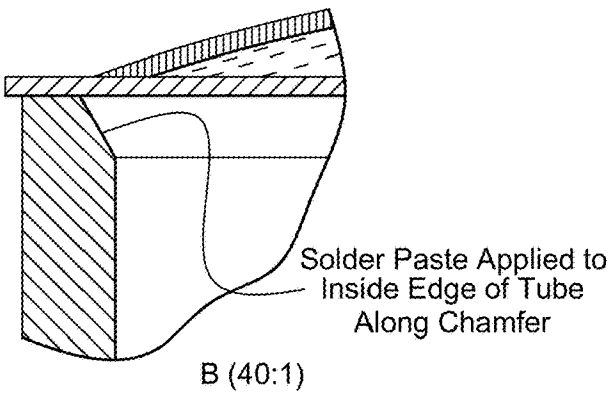
Figure 5A:
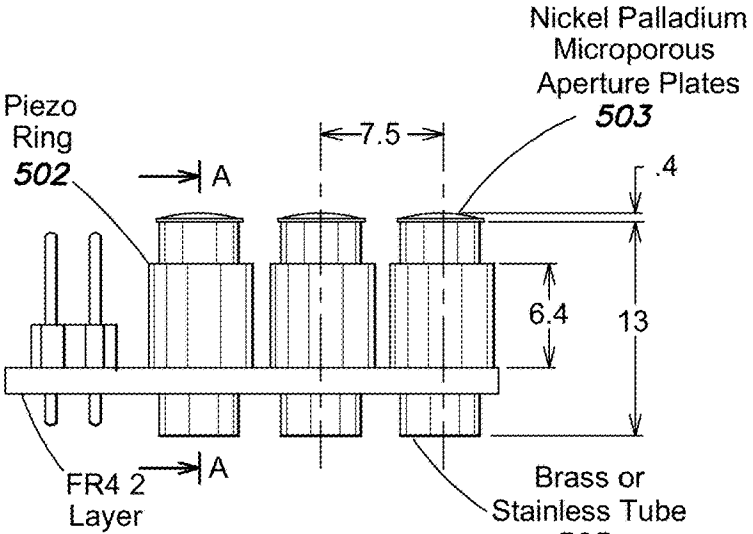
Figure 5C:
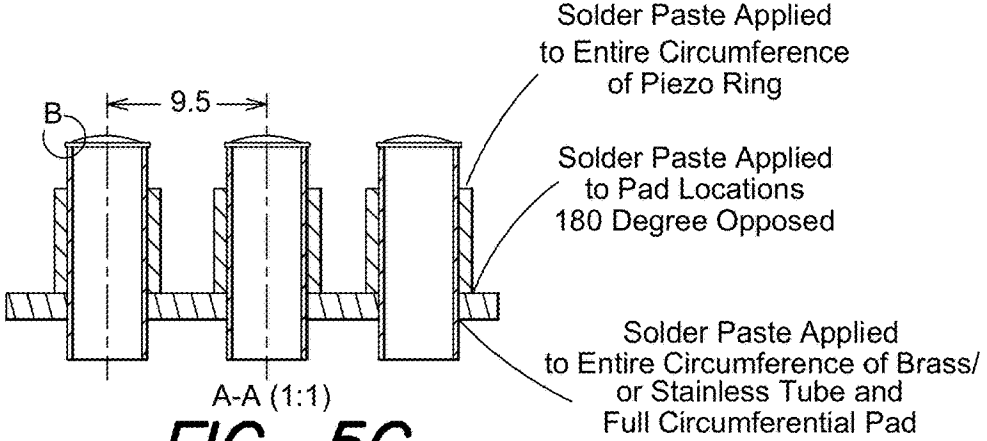

FIGS. 3A-3F show various embodiments and views of an assembly having an array of multiple cylindrical tubes. In particular, FIG. 3A shows an assembly 301 including a printed circuit board (PCB) having power and control circuitry that is used to selectively activate one or more piezo-based tubes within the tube assembly. The tube assembly may form an array of tubes (e.g., tube array 303), each of which tubes may be selectively activated. For instance, each of the tubes in the array may hold different scented media, and a system selecting such media may be configured to produce different scents.

Each of the tubes (e.g., tube 302) may be mounted on a mounting structure. In some embodiments, the tubes are mounted to isolate them vibrationally from other tube elements. In some cases, spacers or other elements may isolate the tube elements. In some embodiments, piezo elements of each tube (e.g. piezo element 305) are positionally separated by adjacent tubes yet are mounted by a common electrical connection (e.g., via a separate PCB). The system may have a grouping of electrical connections 304 that permits a connected system to send electrical signals that activate selected aerosol generating devices. In some cases, there may be isolation elements that isolate each tube from the mounting structure.

FIGS. 4A-4E show embodiments of another type of cylindrical tube that may be used to generate aerosol. For example, the cylindrical tube 401, piezoelectric element 402, and mesh plate 403 may have different dimensions and therefore may have different resonant frequencies and operating characteristics that tubes of other sizes.

In some embodiments, an adhesive such as solder or other type of material couples the tube and the piezo element associated with the tube, and substantially fills any gaps between the piezo element and the tube outer wall. Further, solder or other type of adhesive may be used to attach the mesh plate to the tube end, which may include, in some embodiments, a chamfered front edge to permit a larger solder bonding surface.

FIGS. 5A-5D show further embodiments of an example assembly having an array of cylindrical tube elements. As shown in FIGS. 5A-5D, multiple ones of tube structures shown in FIGS. 4A-4E may be combined into an assembly similar in structure to that shown in FIGS. 3A-3F. In particular, multiple aerosol generators that include a tube (e.g., a brass or stainless tube 501), a ring-shaped piezo element (e.g., piezo ring 502), and aperture plate (e.g., a nickel palladium aperture plate 503), may be mounted on a structure (e.g., a circuit board (PCB)) having power and control circuitry that is used to selectively activate one or more piezo-based tubes within the tube assembly. In particular, the tubes may be positioned on the PCB to form a tube array 506 on assembly 504. Assembly 504 includes a set of electrical connectors 505 that are used to pass electrical activation signals to the piezo-based tubes. As discussed above, the electrical signal may be, in some embodiments, an alternating signal that is applied to contacts of the piezoelectric element (e.g., which is applied to electrical connectors 505 to selectively activate generators in the array). Although such assemblies are shown by way of example, it should be appreciated that the assemblies can take any number of forms, and may include more or less piezo-based aerosol generators.

Example Implementations

One example use of such a device according to various embodiments includes aerosol generation of scented liquids (such as for an AR/VR application described in an example application as discussed with more particularity in U.S. patent application Ser. No. 16/219,028, entitled "SYSTEM AND METHOD FOR GENERATING OLFACTORY STIMULI" filed on Dec. 13, 2018, which is hereby incorporated by reference in its entirety), but it can also be for turning any liquid (e.g., aqueous and non-aqueous) into a mist. In particular, the device may be used to atomize scented material, i.e., the ability to turn scented liquids into mist using vibration and micro-pores to allow the scent permeate in the air in specific quantities. As discussed, the device may be used to generate scented liquid media (e.g., such as nanoemulsions) into aerosols which can be perceived by users.

In other examples, the device may be used to atomize media such as liquid forms of *cannabis* into aerosol for inhalation: For instance, liquid forms of *cannabis* or cbd oils, waters or other aqueous solutions may be atomized and inhaled by users. Other media that may be used could include emulsions, solutions, mixtures, and inclusions. In such a case, the generator device may be part of a larger delivery mechanism (e.g., an e-cigarette, vaporizer, or other device) that allows users to inhale atomized liquids or other media types.

In some other applications, the device may be used for dispersing medical liquids (e.g., dispersing certain medicines in an atomized form for inhalation using conventional VMT technology. For instance, VMT devices used in nebulizers could be adapted using some of the embodiments described herein for that purpose.

Some other applications include:

- gel to liquid conversion: certain theoretic gels have attributes where vibration turns them from a gel into a liquid which would allow for atomization through the device. This could be used primarily to do gel coatings as after vibration, the liquid would coalesce back into a gel.
- volatile liquid atomization—alcohol, ethanol, gasoline, Benzine: For instance, it may be beneficial to able to atomize various less common liquids for reasons like combustion engines.
- water humidification In some embodiments, the size specification for the device may be relatively small, especially in applications where multiple devices may be used in parallel, such as within a larger device. Other applications (such as an e-cigarette application), the permitted dimension and/or may be limited to a relatively small form factor. Other applications may use a larger form factor, such as a large mist "cannon" that could be used to vaporize large amounts of water or scent or used as part of an engine.

One implementation includes a tube having a rectangular or square in shape. In some conventional piezo elements, they may use a pinching/squeezing mechanism to deliver liquids, however, in some embodiments as disclosed herein, a medium (e.g., a liquid) is aerosolized is via perpendicular acoustical waves induced by a piezo element.

In some implementations, there are a few ways that the medium can come into contact with the plate.

Free in housing: the liquid is just free in the tube and capped at the end opposite the aperture plate end to seal the liquid inside. The vibration pattern forces the liquid in contact with the plate.

Wick: A wick is placed in the tube and capped in with the liquid to force the correct capillary action to move the liquid to plate in conjunction with the vibration. In some embodiments, the wick may be shaped to fill the area within the tube (e.g., a rectangular, tubular, or square shape). In some implementations, the wick element may be a replaceable item, and may be accessible to be replaced. The wick may also be part of or coupled to a reservoir that holds liquid to be dispersed. The wick may be, in some embodiments, bidirectional or unidirectional wicking material made out of, for example, natural fibers and/or synthetic fibers including cotton, polyethylene, nylon, metal, graphene, among others. Further, the wick may be sized to form a gap between the wick and the tube which permits the tube to vibrate. In some embodiments, a straw-like structure may be provided that surrounds the wick, is inserted into the tube to provide liquid to the tube, and maintains a gap distance to permit the tube to vibrate. In some embodiments, the wick may contact the aperture plate, and in some embodiments, a mechanical action (e.g., a rear compression action) may push the wick to contact the aperture plate, allowing fluid to wick towards the aperture plate).

Cartridge: A cartridge of custom design is inserted into the back to the tube with a connection point to the tube and plate. The cartridge may, or may not, use a wick or material that has a wicking property. In some embodiments, the cartridge may be a removable item, the cartridge in some embodiments containing the liquid(s) and/or wick material and may be easily replaced. In some implementations, the wick and liquid-containing chamber may be removable from the aerosol generating devices to ease replacement and reduce overall operating cost of the device.

For example, various embodiments as described herein may be used alone or in combination with any other feature or aspect, such as those shown by way of example in U.S. patent application Ser. No. 16/219,028, entitled "SYSTEM AND METHOD FOR GENERATING OLFACTORY STIMULI" filed on Dec. 13, 2018, which is hereby incorporated by reference in its entirety. In some embodiments, such aerosol devices may be used in association with XR (e.g., AR, VR) applications and/or devices, or other types of control systems.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A device comprising:

a tube having a proximal opening and a distal opening, wherein the tube contains a wick element that delivers a medium to be dispersed;

an aperture plate coupled to the proximal opening of the tube, the aperture plate having a plurality of apertures and being in contact with the wick element contained within the tube;

a piezoelectric element attached to a surface of the tube, the piezoelectric element adapted to receive an electrical signal that causes the piezoelectric element to vibrate and induce a wave along a length of the tube that forces the medium through the plurality of apertures within the aperture plate, and wherein the device is operated at a resonant frequency to generate an aerosol from the medium being forced through the plurality of apertures within the aperture plate;

wherein the tube has a circular cross-sectional shape and wherein the piezoelectric element is disposed about a circumference of the tube.

2. The device according to claim 1, wherein the tube is adapted to receive the medium through the distal opening.

3. The device according to claim 1, wherein the medium includes at least one of a solid, a liquid and a gel.

4. The device according to claim 1, wherein the piezoelectric element forms a unimorph element with the tube.

5. The device according to claim 1, wherein the piezoelectric element is adapted to vibrate the tube in a direction perpendicular to its length.

6. The device according to claim 1, wherein at least one of the plurality of apertures is formed within the aperture plate coupled to the proximal opening of the tube.

7. A system comprising the device of claim 1.

8. The device according to claim 1, wherein the plurality of apertures within the aperture plate are located at the proximal opening of the tube.

9. The device according to claim 8 further comprising a chamber and an aerosol generator, wherein the wick is in contact with the aperture plate, and liquid is transferred from the chamber to the aperture plate of the aerosol generator by capillary action.

10. The device according to claim 1, wherein the tube, the aperture plate, and the piezoelectric element are sized to produce the aerosol at the resonant frequency.

11. The device according to claim 1, wherein a resonant frequency of the piezoelectric element is the same value as a resonant frequency of the aperture plate.

12. The device according to claim 1, wherein the medium to be dispersed is used by the device to generate scent.

* * * * *